United States Patent [19]

Salomon

[11] Patent Number: 4,603,880

[45] Date of Patent: Aug. 5, 1986

[54] SKI BINDING

[75] Inventor: Georges P. J. Salomon, Annecy, France

[73] Assignee: Salomon S.A., Annecy, France

[21] Appl. No.: 328,144

[22] Filed: Dec. 7, 1981

[51] Int. Cl.[4] ..... A63C 9/084

[52] U.S. Cl. ..... 280/628; 280/630; 280/632; 280/634

[58] Field of Search ..... 280/628, 629, 630, 631, 280/632, 634

[56] References Cited

U.S. PATENT DOCUMENTS

| | | | |
|---|---|---|---|
| 3,572,739 | 3/1971 | Erlebach | 280/628 |
| 3,689,095 | 9/1972 | Salomon | 280/628 |
| 4,095,821 | 6/1978 | Salomon | 280/628 |
| 4,218,071 | 8/1980 | Salomon | 280/630 |
| 4,243,246 | 1/1981 | Weigl | 280/628 |
| 4,402,525 | 9/1983 | Salomon | 280/628 |
| 4,405,153 | 9/1983 | Salomon | 280/634 |

FOREIGN PATENT DOCUMENTS

| | | | |
|---|---|---|---|
| 305106 | 2/1973 | Austria . | |
| 2916348 | 11/1979 | Fed. Rep. of Germany . | |
| 1534440 | 6/1968 | France . | |
| 1580251 | 7/1969 | France . | |
| 2014481 | 4/1970 | France . | |
| 2027531 | 10/1970 | France . | |
| 2045158 | 2/1971 | France . | |
| 2049433 | 3/1971 | France . | |
| 2048363 | 3/1971 | France . | |
| 2480130 | 4/1980 | France | 280/628 |

*Primary Examiner*—John J. Love
*Assistant Examiner*—Joseph G. McCarthy
*Attorney, Agent, or Firm*—Sandler & Greenblum

[57] ABSTRACT

Ski safety binding which maintains one end of a ski boot or shoe secured to a ski. The binding includes:

(a) a jaw for securing the sole of a shoe or boot to the ski, when the binding is in the locked position;

(b) a pivot to be secured to the ski;

(c) a rotatable element mounted pivotably on the pivot;

(d) a body having a movable element configured to be biased against a rocker, the rocker being pivotably mounted relative to the rotatable element; and wherein the bias of the movable element against the rocker is adapted to bias the jaw against the sole when the binding is in the locked position.

37 Claims, 30 Drawing Figures

SKI BINDING

BACKGROUND OF THE INVENTION

1. Field of the Invention

The present invention relates to a safety binding adapted to maintain one end of a ski shoe or boot on a ski.

2. Description of Prior Art

Numerous bindings are known which comprise a jaw for maintaining the shoe, the jaw being positioned in a fashion so as to be able to be displaced between a retention position of the shoe on the ski and a release position of the shoe. Generally, this displacement occurs in the direction of a rotation around an axis transverse to the ski and this displacement occurs against a force exerted by an elastic system. In this instance, the release occurs only when there is a vertical force called a flexional force at the heel. This can, under certain circumstances, present certain inconveniences and designers have proposed bindings releasing the shoe, not only vertically, but also laterally, by positioning the jaw on a cardan-type mounting or in a manner so as to be movable around a sphere, thus permitting the jaw to pivot in all directions.

The present invention relates to improvements to the above types of bindings and comprises a particularly simple and reliable apparatus allowing for the release of the shoe or boot vertically as well as laterally.

SUMMARY OF THE INVENTION

While the invention relates in its broadest sense to safety bindings adapted to maintain one of the ends of a shoe or boot on the ski, according to a preferred embodiment, the invention relates to heel safety bindings which ensure the maintenance of the heel of the shoe on the ski while allowing for the release of the shoe in the event an excessive force is exerted on the shoe.

Generally, the invention relates to a safety binding which is adapted to maintain one end of a ski boot or shoe secured to a ski. The binding includes a jaw which is adapted to secure the sole of the shoe or boot to the ski when the binding is in the locked position, and a pivot which is adapted to be secured to the ski. A rotatable element is provided which is mounted on the pivot and the apparatus includes a body which comprises a movable element adapted to be biased against a rocker which is pivotably mounted relative to the rotatable element. The bias of the movable element against the rocker is adapted to bias the jaw against the sole when the binding is in the locked position.

The rocker may be provided with an incline, with the movable element being biased against the incline so as to exert a vertical force on the body when the binding is in the locked position. The incline is configured so as to bias the jaw away from the sole upon movement of the movable element past a release point on the incline due to upward force exerted on the jaw by the sole.

The incline may be segmented into a release portion which is adapted to force the movable element away from the pivot during upward vertical movement of the jaw, and a holding portion which is adapted to hold the jaw in the open position. The release and holding portions are separated by the release point.

Physically, the body extends rearwardly away from the pivot and the body may be either integral or distinct from the jaw.

In the embodiment of the invention wherein the jaw and body portions are distinct from one another, the body may be pivotably secured to the jaw along a first axis which is transverse to the longitudinal axis of the pivot. The rotatable element is positioned in a space which is provided between the jaw and the body, with the jaw being pivotably mounted on the rotatable element along a second axis which is also transverse to the longitudinal axis of the pivot. A portion of the jaw and a portion of the body are biased into direct physical contact with each other when the binding is in the locked position, and manual release of the binding occurs in two distinct phases around each of the first and second axes. In this embodiment there is a two-stop mechanism, with each of the stops being positioned on opposite sides of the rotatable element.

With respect to the pivot itself, the pivot is generally cylindrical and extends along a longitudinal axis which is generally transverse to the plane of the ski. The pivot comprises a notch which is adapted to seat a pin which extends generally transversely to the longitudinal axis of the pivot. This pin pivotably secures the jaw to the pivot. The pivot has a support surface which is integral therewith and which is adapted to support the rocker during pivoting of the rotatable element around the longitudinal axis of the pivot. The support surface which supports the rocker may be flat, while the rocker, in this embodiment, comprises a flattened surface which is adapted to contact the flat support surface of the pivot, whereby rotation of the rocker around the pivot angularly and rotationally displaces the surfaces whereby the rocker compresses the movable element which resists displacement.

According to another embodiment, the support surface of the pivot may be in the form of a "V"-shaped notch. In yet another embodiment, the support surface of the pivot comprises a flattened portion which is bordered by two projecting portions. According to another embodiment of the invention, the support surface on the pivot is itself in the form of a projecting rib and the rocker comprises a notch which is adapted to seat the projecting rib, whereby the rotation of the rocker around the pivot angularly and translationally displaces the projecting rib relative to the notch.

The rotatable element has a vertical bore which is adapted to receive the pivot and, in one embodiment, includes first and second sets of horizontally arranged bores which are adapted to provide first and second pivot axes for the jaw and the rocker relative to the pivot.

In another embodiment, only one set of horizontally arranged bores is provided which is adapted to provide a pivot axis for both of the jaw and rocker relative to the pivot.

The rocker may be configured so as to comprise an opening which is adapted to seat the rotatable element, and can, in one embodiment, include a projection which is seated within a support surface on the pivot, which is adapted to resist rotation of the rotatable element relative to the pivot.

In yet another embodiment, the rocker pivots around an axis positioned intermediate the two ends of the rocker and is biased by the movable element against the pivot so as to press against one of two support surfaces on the pivot. In this embodiment, rotation of the rotatable element causes the translational movement of the movable element along the rocker, whereby bias of the rocker against either of the two support surfaces corresponds to two different stable positions of the jaw.

The jaw itself may comprise an interior surface which is adapted to cooperate with the pivot to resist lateral movement of the jaw when the jaw is in a position securing the shoe or boot to the ski. This resistance can be overcome either by a vertical force exerted by the shoe against the jaw or by a lateral force which is strong enough to overcome pressure exerted by the movable element against the piston, allowing for the liberation of the jaw and its subsequent rotation. In this embodiment of the invention, the interior surface of the jaw can comprise a notch, with the pivot comprising a projecting element which is adapted to be seated within the notch. Alternatively, the interior surface of the jaw can comprise a projecting element with the pivot comprising a notch adapted to seat the projecting element.

The movable element can be in the form of a piston which comprises a pressure nose which is slidably mounted within the body. The piston can comprise a longitudinal groove, while the body in this embodiment includes a finger which is secured to the body and which is adapted to slidably extend into the groove to prevent rotation of the piston relative to the body.

As was noted above, the rocker may be pivotably mounted around a first pivot axis, with the jaw being vertically mounted around a second pivot axis, the first and second pivot axes being the same axis. Alternatively, the rocker is pivotably mounted around a first pivot axis and the jaw is pivotably mounted around a second pivot axis, the two pivot axes being different. In this latter embodiment, the first pivot axis is positioned further from the ski than the second axis, i.e., the first pivot axis is higher off the ski than the second pivot axis.

BRIEF DESCRIPTION OF THE DRAWINGS

The invention will now be described by way of non-limiting example, the various embodiments of the invention illustrated in the annexed drawings in which:

FIGS. 1–11 and 17 illustrate a preferred embodiment of the invention while

FIG. 1 is a lateral, longitudinal cross-sectional view illustrating the binding securing the shoe;

FIG. 2 is a similar view showing the binding in the course of a vertical release;

FIG. 3 is a cross-sectional view along line III—III of FIG. 1;

FIG. 4 is a perspective view showing a detail of the binding;

FIG. 5 is a cross-sectional view along line V—V of FIG. 2;

FIG. 6 is a perspective view showing a detail of the binding;

FIG. 7 is a perspective view highlighting the rear portion of the rocker;

FIG. 8 is a perspective view illustrating the piston and its pressure nose;

FIG. 9 is an exploded perspective view particularly illustrating the pivoting element and the rocker;

FIG. 10 is a top, partially exposed, of the inventive device;

FIG. 11 is a cross-sectional view along the line XI—XI of FIG. 10 showing the binding in the event of vertical bias combined with lateral bias;

FIG. 12 illustrates a partially exposed cross-sectional view of an alternative embodiment;

FIG. 13 is a view similar to FIG. 12, with the binding having undergone a vertical pivoting;

FIG. 14 is a perspective partial view illustrating the lower portion of the jaw utilized in FIGS. 12 and 13.

FIG. 15 illustrates the pivot utilized in the embodiment of FIGS. 12 and 13;

FIG. 16 is a cross-sectional view along line XVI—XVI of FIG. 12;

FIG. 17 is an exploded cross-sectional view along line XVII—XVII of FIG. 1;

FIG. 18 is a view similar to FIG. 16 illustrating an alternative embodiment;

FIG. 19 is a partial view showing an alternative embodiment of cooperation between the rocker and the pivots;

FIG. 20 illustrates in perspective an alternative support zone;

FIG. 23 is a partial cross-sectional view of the binding holding the boot on the ski;

FIG. 24 is a partial cross-sectional view illustrating the apparatus with the boot removed after release;

FIGS. 25 and 26 are perspective views of two parts of the mechanism;

DESCRIPTION OF PREFERRED EMBODIMENTS

Figure 1:
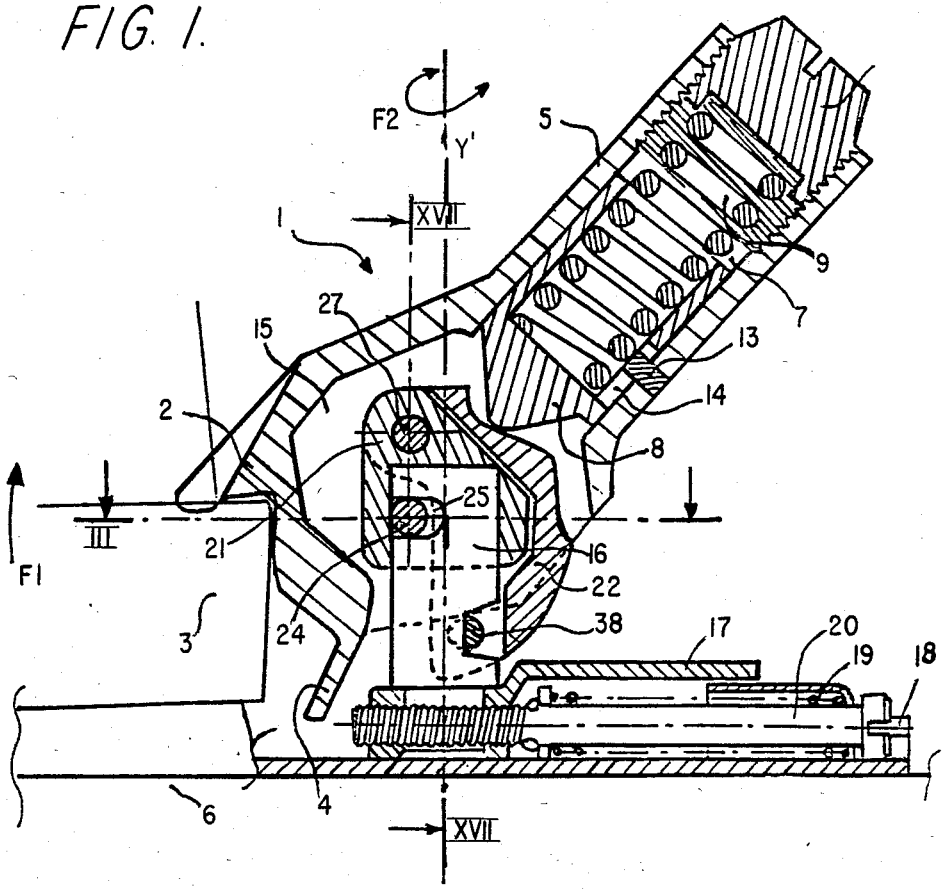

According to the invention, a safety binding for securing one end of a ski shoe or boot onto a ski is disclosed which comprises a jaw 2 journalled with respect to a support 17 around a first transverse axis and a body comprising a mobile element biased by a spring against an incline linked to the support so as to assure the vertical maintenance of the jaw. The first axis is positioned on a turnable element journalled around a second, vertical, axis carried by a pivot secured to the support. The incline is positioned on a rocker journalled on the turning element around a transverse axis such that the action of the mobile element on the incline applies a portion of the rocker against a support portion attached to the support to assure the lateral maintenance of the jaw.

According to one complementary embodiment of the invention, the lateral pivoting of the jaw is not possible until after a vertical pivoting thereof.

According to another characteristic of the invention, the rocker can assume two positions, one of which assures the lateral maintenance of the jaw in the position corresponding to the shoe being secured while the other position assures the maintenance of the jaw in the lateral position corresponding to the jaw being removed from the binding such as after release.

According to the first embodiment, and with reference to FIGS. 1–11 and 17, the binding comprises a retention assembly 1 comprising a jaw 2 adapted to maintain a heel 3 (for example) of a shoe or boot on the ski. The retention assembly has at its lower portion an insertion pedal 4 which projects outwardly and a body 5 extending rearwardly and preferably upwardly which is adapted to serve as a release lever. The retention assembly 1 is positioned so as to be movable in all directions with respect to the ski 6 against the bias of an elastic system. To do this, the body 5 comprises a bore 7 along its general axis to receive the elastic system constituted by a sliding piston 8 biased by a spring 9. An adjustment cap 10 is screwed to the rear portion of the body for adjustment of the initial tension of the spring. The opening 7 is cylindrical and the piston 8, having a corresponding configuration, slides along the axis of the bore.

Figure 8:
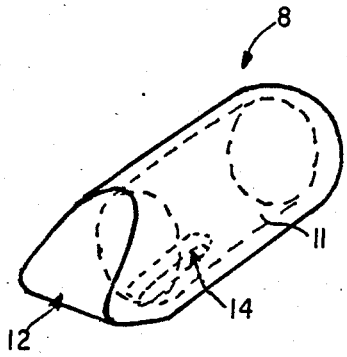
Figure 9:
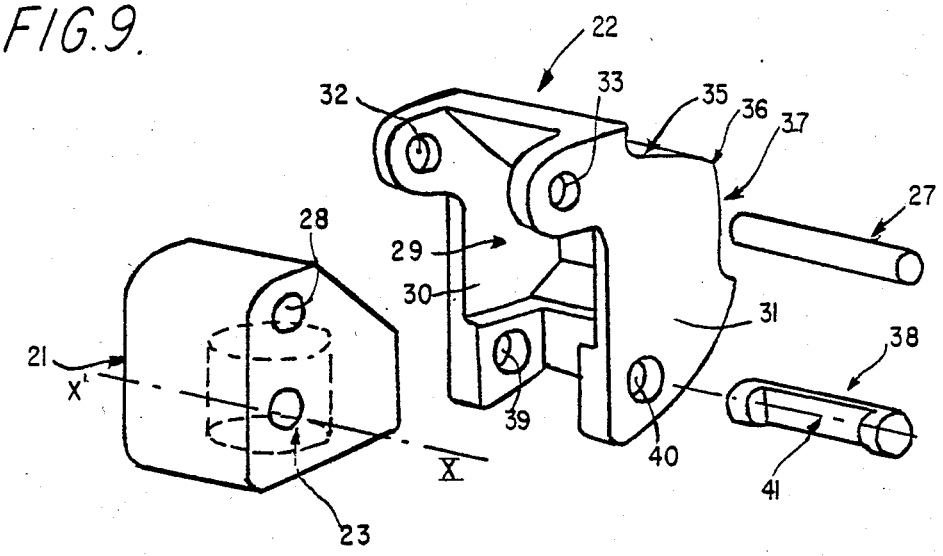

As seen in FIG. 8, piston 8 comprises a cylindrical portion 11 and a transverse pressure nose 12 extending perpendicularly to the sliding axis. The piston is free to move in translation and is blocked in rotation by a finger 13 which is secured relative to body 5 and which cooperates with a longitudinal groove 14 provided in the piston 8. The retention assembly 1 is positioned so as to be able to pivot vertically along the direction $F_1$ around a horizontal axis XX' and laterally along $F_2$ around a vertical axis YY'. To achieve this, the retention assembly 1 comprises an opening 15 which opens downwardly and is positioned between the jaw 2 and the body 5 to receive a pivoting assembly. The pivoting assembly is mounted pivotably on a pivot 16 having a generally cylindrical shape which extends vertically relative to the ski and serves as a pivot for rotation around the vertical axis YY' of the retention assembly 1. The pivot 16 is linked to the ski 6 in a fashion which is in itself well known and which need not be described in detail. It need only be noted that the pivot 16 is attached on a support 17 which slides in a track 18 attached to the ski 6. This sliding occurs against the force exerted by a spring, called a pressure spring 19, positioned around an adjustment screw at position 20.

Figure 2:
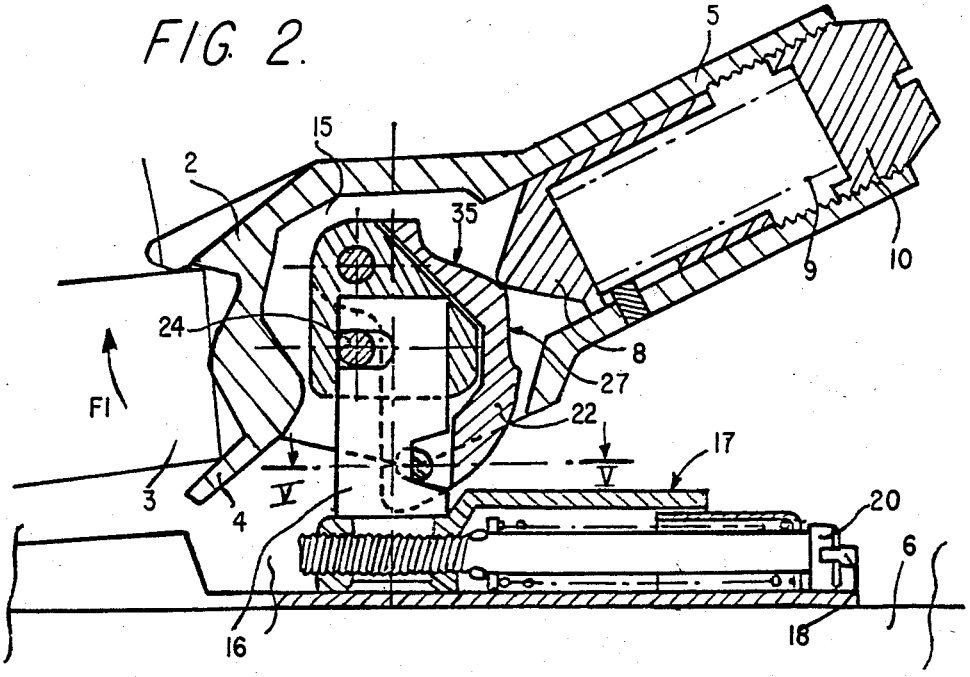
Figure 3:
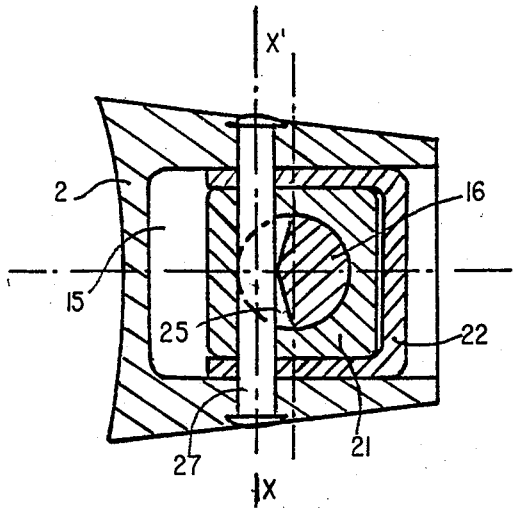
Figure 4:
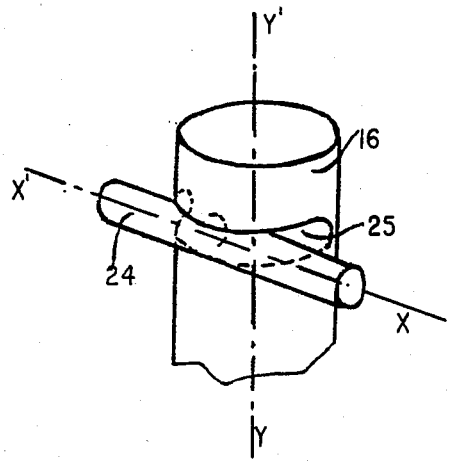
Figure 5:
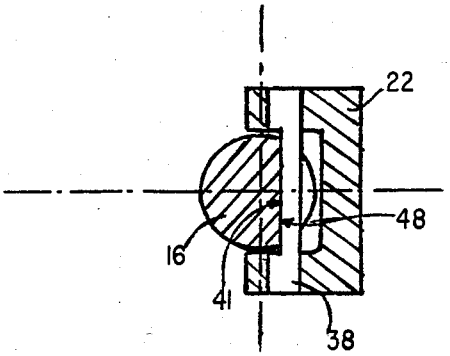

The pivoting assembly comprises a turning element 21 in the form of a cap and a rocker 22. This assembly is positioned in the opening 15 in a fashion so as to be integral with the retention assembly 1 during lateral pivoting along the direction $F_2$ around the pivot 16. To do this, the turning element 21 is rotated around pivot 16 and for this purpose comprises a cylindrical bore 23 opening downwardly receiving the upper portion of the pivot 16. The rotating element 21 is blocked in vertical translational movement by a pin 24 positioned in a notch 25 provided over a portion of the pivot 16 allowing for the rotation of the pin 24 (FIG. 4). As can be seen in FIGS. 2 and 3, the axis 24 is perpendicular to the axis YY' and serves as a general axis XX' (FIG. 3) for the vertical pivoting of the jaw. On the other hand, rocker 22 is pivotably positioned with respect to the rotating element around an axis 27 parallel to the axis 24 positioned in a hole 28 extending through the upper portion of the rotating element.

Figure 6:
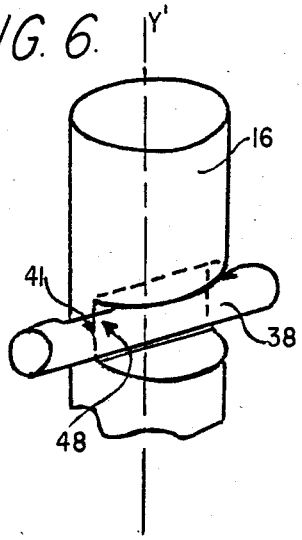
Figure 7:
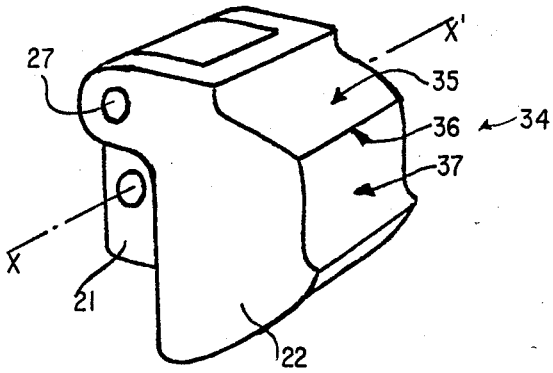

The rocker 22 comprises at its front portion an opening 29 (FIG. 9) in which the rotating element 21 is positioned. Opening 29 is defined by two lateral walls 30 and 31 which are thus positioned between the rotating element 21 and the retention assembly 1 (see FIG. 3). Furthermore, the axis 27 extends through two aligned holes 32 and 33. It is noted that the pivoting assembly is integral during lateral pivoting with the retention assembly. On the other hand, the rocker 22 comprises at its rear portion an incline 34 against which the piston 8 is applied under the action of spring 9. Incline 34 comprises a release ramp 35 followed by a release stop 36 and then by an opening incline 37. It will be noted that the release incline 35 compresses the piston 8 during pivoting around axis XX' formed by pin 24 and that the incline 37 is slightly decompressive with respect to the same axis to assure the maintenance in the open position of the binding. At its lower portion, the rocker 22 comprises a support or activating portion formed out of a transverse pin 38. This pin is positioned in two aligned holes 39 and 40 (FIG. 9) and comprises a planar or flattened portion 41 biased to rest against a flattened surface 48 formed at the lower and posterior portion of the pivot 16. The pin is adapted to position itself correctly by virtue of its two cylindrical ends positioned in holes 39 and 40 (FIG. 6).

FIG. 2 illustrates a vertical release along the direction $F_1$. It will be noted that in this case the jaw pivots around its axis pin 24 and the piston 8 is pushed away by the release ramp 35. When the pressure nose 12 has gone beyond the release point 36 the boot is released.

Figure 10:
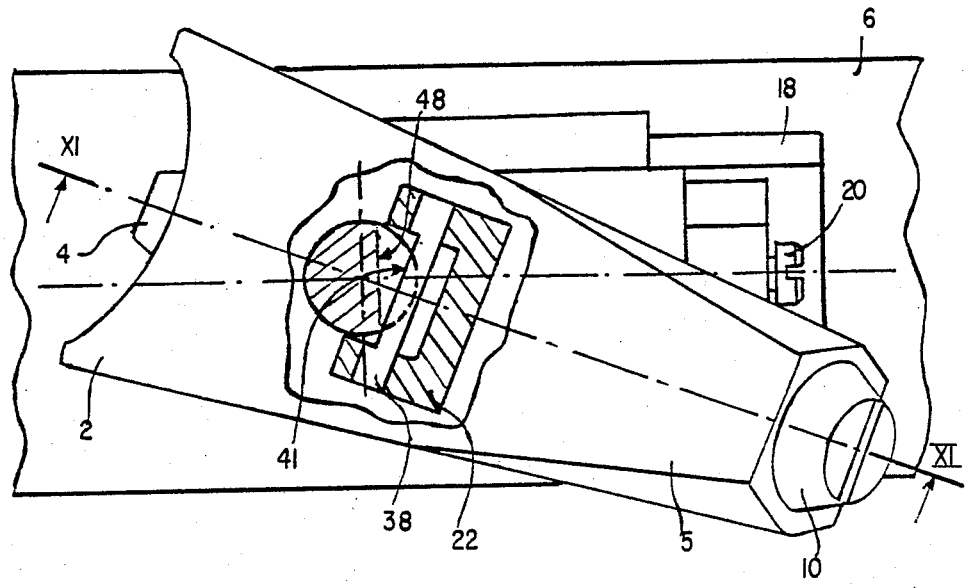
Figure 11:
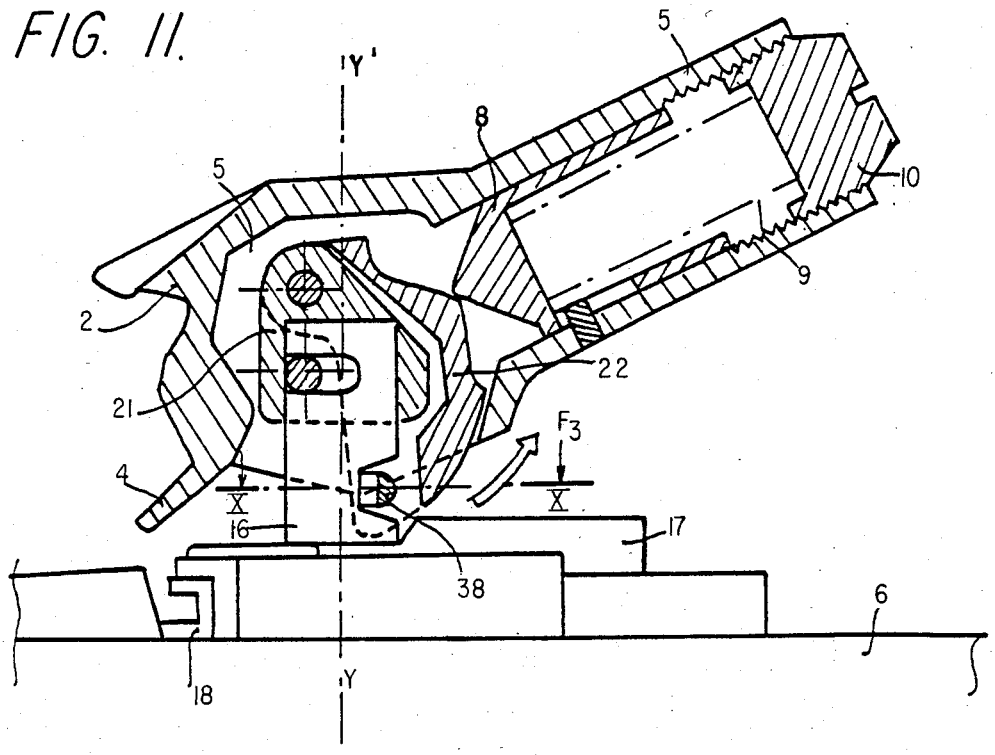
Figure 12:
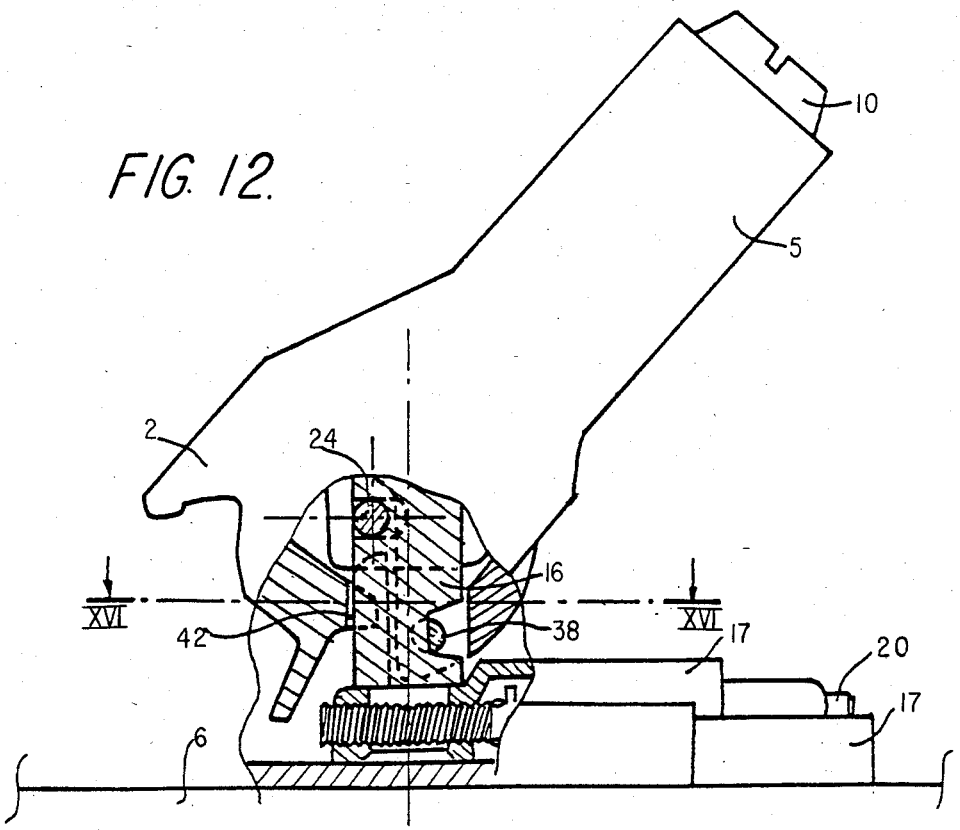
FIGS. 12–16 and 18–20 illustrate alternative embodiments.

FIGS. 10 and 11 illustrate how release occurs under the effect of a vertical force combined with a lateral force. In this case, there is a simultaneous pivoting, on the one hand, around the vertical axis YY' and on the other hand around the horizontal axis XX'. It will be noted that during lateral pivoting in the direction $F_2$, the flattened portion formed on the pivot pushes the rocker by forcing it to pivot along the direction $F_3$ (FIG. 11) around axis 27. This pivoting occurs against the force of the elastic system because it forces the piston to retract.

Figure 13:
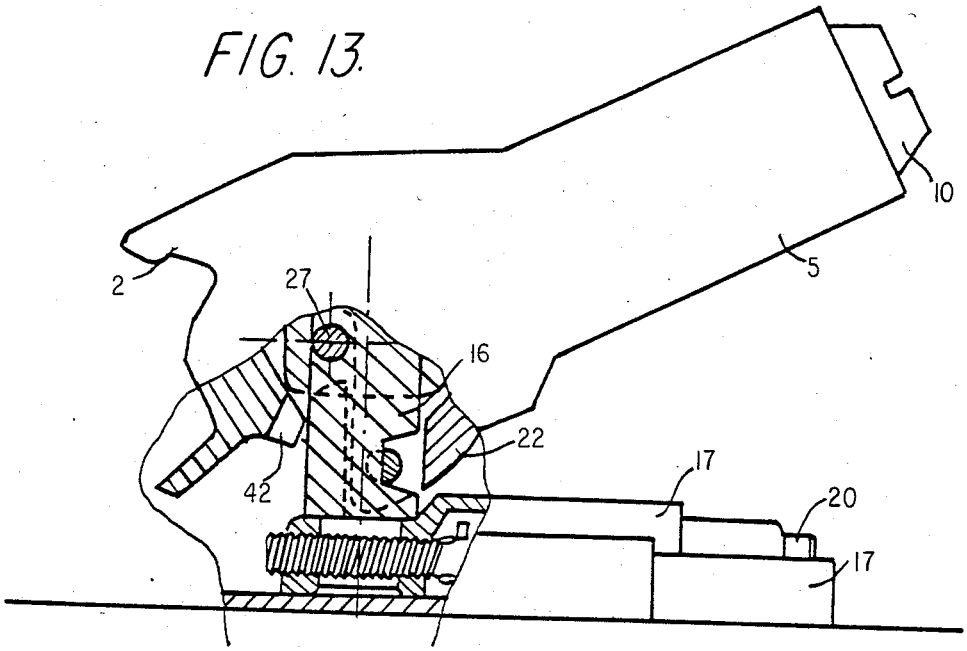
Figure 14:
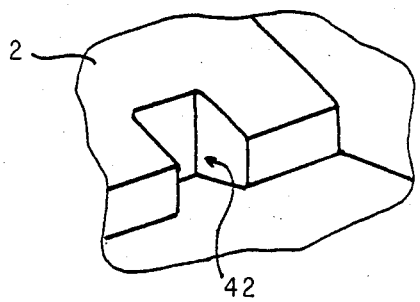
Figure 15:
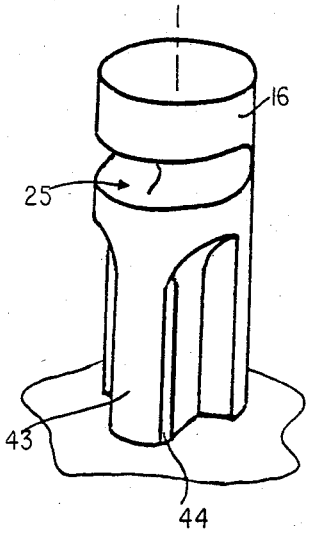
Figure 16:
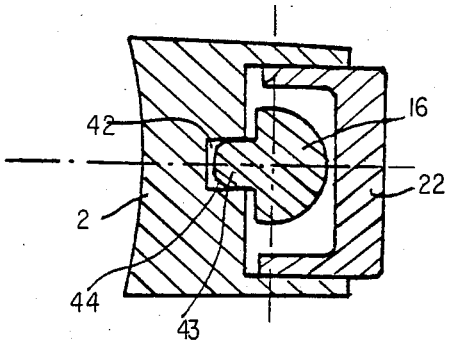
Figure 17:
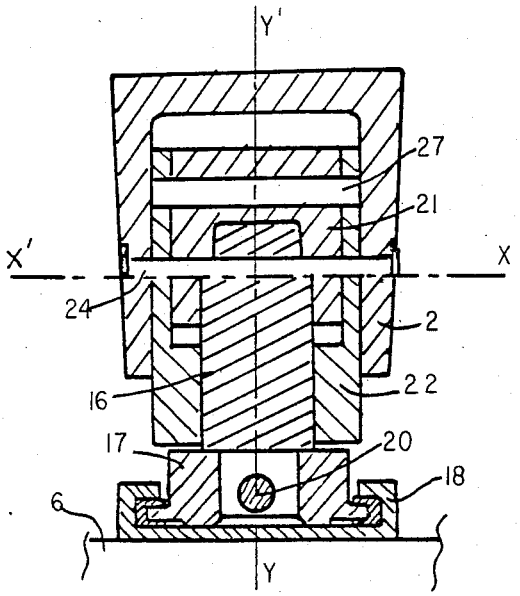

FIGS. 12–16 illustrate a complementary aspect of the invention. In this aspect, the lateral pivotable movement around the axis YY' is not possible until after a certain amount of vertical pivoting of the jaw around the horizontal axis XX' has occurred. To achieve this, the lower portion of the jaw comprises a notch 42 (FIG. 14) which cooperates in the retention position of the heel with the projecting element 43 formed on the pivot 16 (FIG. 15). It is thus seen that pure lateral pivoting around the axis YY' is prohibited (FIGS. 12 and 16) but is possible after a vertical pivoting as is shown in FIG. 13. To facilitate the repositioning of the shoe or boot insertion bevels 44 are provided on the projecting rib element 43 of the pivot 16.

Figure 18:
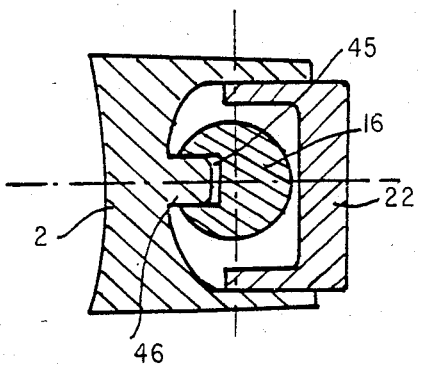

FIG. 18 illustrates an alternative embodiment in which there is a reversal of the projection and the notch. In effect, it is the pivot 16 which carries the notch 45 and the jaw which carries the corresponding projection 46. Again, lateral pivoting cannot occur until after a given vertical pivoting has occurred.

Figure 19:
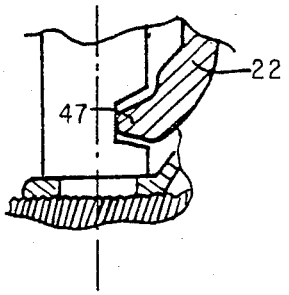

It should also be noted that the rocker could be formed more simply, as has been shown in FIG. 19 where the pivotable pin 38 is replaced by a support or activating portion 47 integral with the rocker 22. The invention is not limited to the shape of the zone on which the support portion of the rocker is applied and there is no limitation as to whether it is integral with the pivot or independent thereof.

Figure 20:
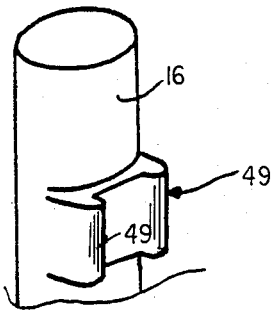

FIG. 20 illustrates an alternative embodiment in which the zone on which the support portion of the rocker is applied is constituted by two projections 49 provided on the pivot 16, which direct activating portion 47 outwardly upon lateral pivoting of the rocker.

Figure 21:
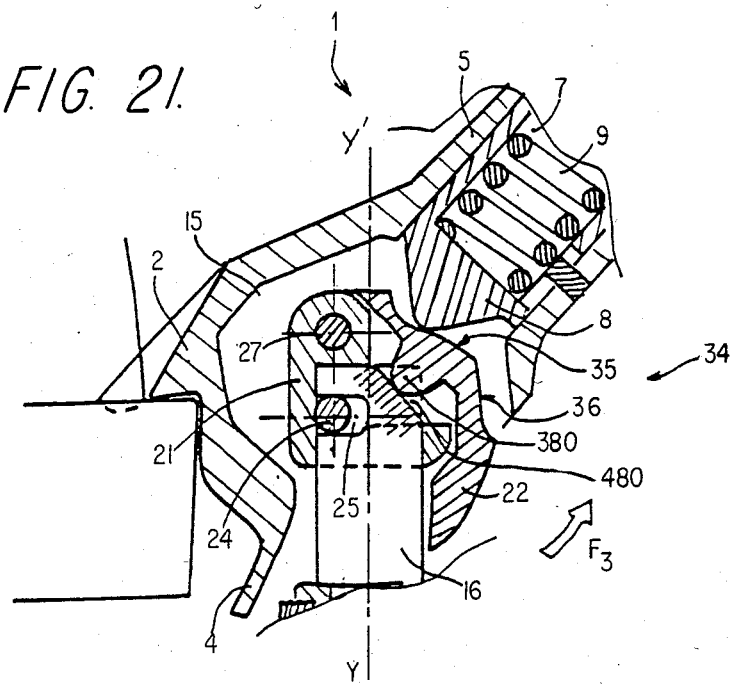
FIGS. 21 and 22 illustrate an alternative embodiment of the rocker.
Figure 22:
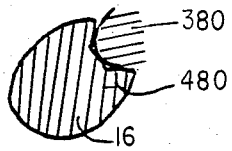

FIG. 21 illustrates an alternative embodiment in which the lateral retention of the retention assembly 1 occurs by virtue of a projection 380 integral with the rocker 22 which cooperates with a notch 480 having a "V"-shaped configuration on the rear upper portion of the pivot 16. Release occurs in this embodiment where lateral forces are great enough to force projection 380 out of notch 480.

Figure 23:
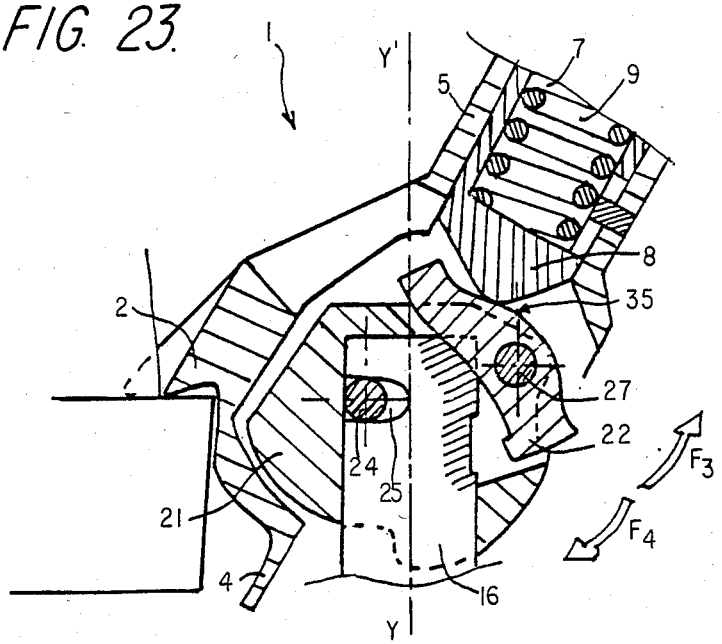
FIGS. 23–26 illustrate yet another embodiment of the invention.
Figure 24:
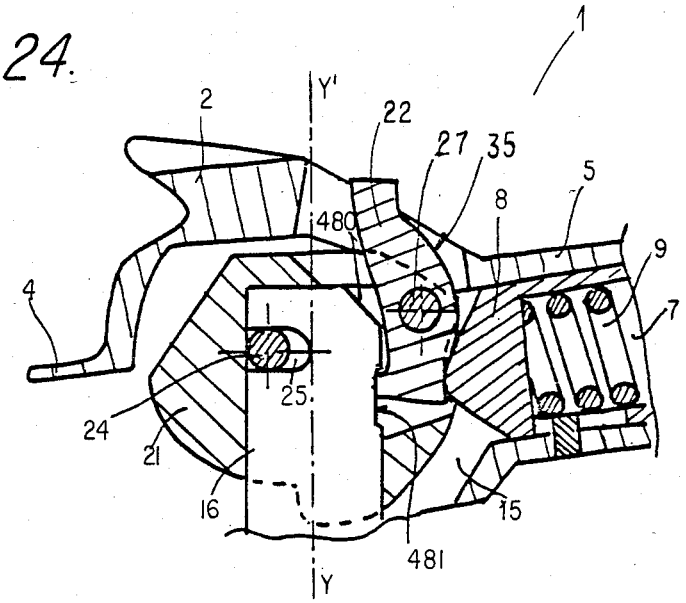
Figure 25:
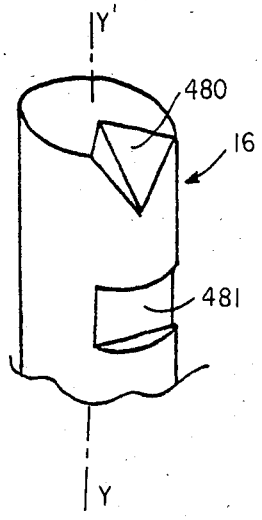
Figure 26:
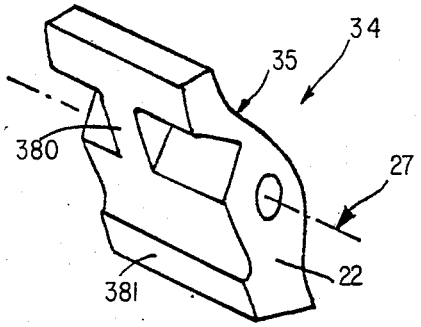

FIGS. 23–26 illustrates an alternative embodiment in which the rocker has two positions. One of these positions, shown in FIG. 23, assures the lateral retention of the jaw 1 in the position in which the boot is secured, while the other position illustrated in FIG. 24 assures lateral retention of the jaw in the position which occurs after release. To this end, pivot 16 comprises two latching notches 480 and 481 illustrated in FIG. 25. The rocker is, as was previously the case, journalled on the rotating element around an axis 27 and comprises at its rear portion a ramp 34. At its front portion the rocker 22 comprises two latching elements 380 and 381. In the position of FIG. 23, i.e., in the position in which the shoe is secured, it will be noted that the rocker is biased along the direction $F_3$ by the elastic system to maintain projecting element 38 in the applied position in the corresponding latching notch 480 having a "V" shape. The lateral retention of the jaw is thus assured. During vertical release, piston 8 moves along incline 35 and when the force of the piston on the rocker passes through the axis 27, the rocker pivots along the direction $F_4$ to pass to the position shown in FIG. 24, which is the position after release, which is ready for reinsertion of the boot. It is noted that in this position the rocker 22 is biased by the piston 8 and presses element 381 against latching notch 481, thus assuring the lateral retention of the jaw.

Figure 27:
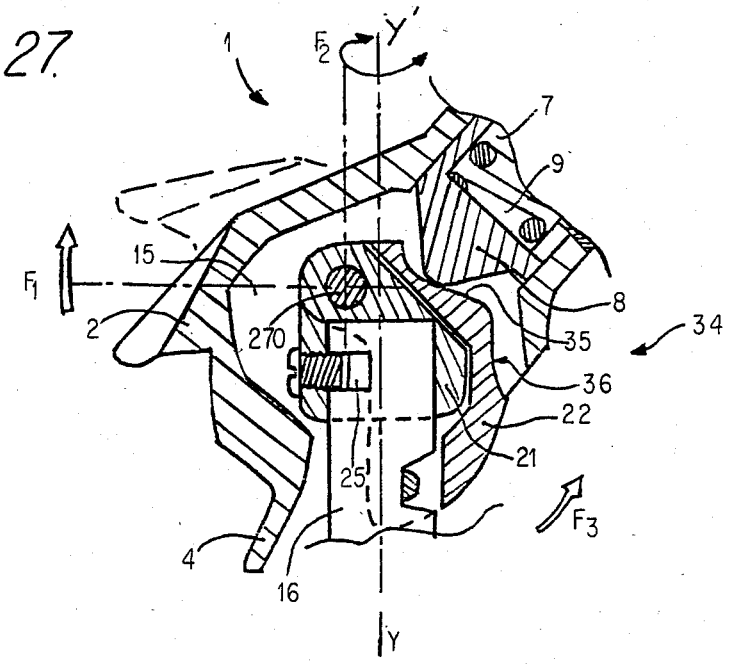
FIG. 27 is a partial view similar to FIG. 1 illustrating an alternative arrangement of the transverse axes.

The invention is not limited to the above particulars and extends to the situation where the two axes 27 and 24 intersect along a single and unique axis 270 such as is shown in FIG. 27. In this embodiment rocker 22 is secured onto pivot 16 by means of a screw 25' which extends into notch 25. Upon pivoting around pivot 16, rocker 22 compresses piston 8 and release occurs when the flattened portion of the pin pivots around the corner of pivot 16.

Furthermore, the movable element could also be a rocker journalled on a transverse axis, the rocker being biased by a spring against the release incline.

In the embodiments shown in FIGS. 1–27 the body 5 is constituted by an extension of the jaw which is integral with the jaw. One can also provide a body 5 which extends from the jaw 2, but which is not integral therewith such as is the case in FIGS. 28 and 29. In effect, it is seen that the body 5, acting as a release lever, is separate from the jaw 2. To this end, the body 5 is journalled on the jaw 2 around a transverse axis 240. On the other hand, a shoulder system (200,500) and (201,501) makes it possible to obtain the voluntary release and automatic insertion of the boot.

Figure 28:
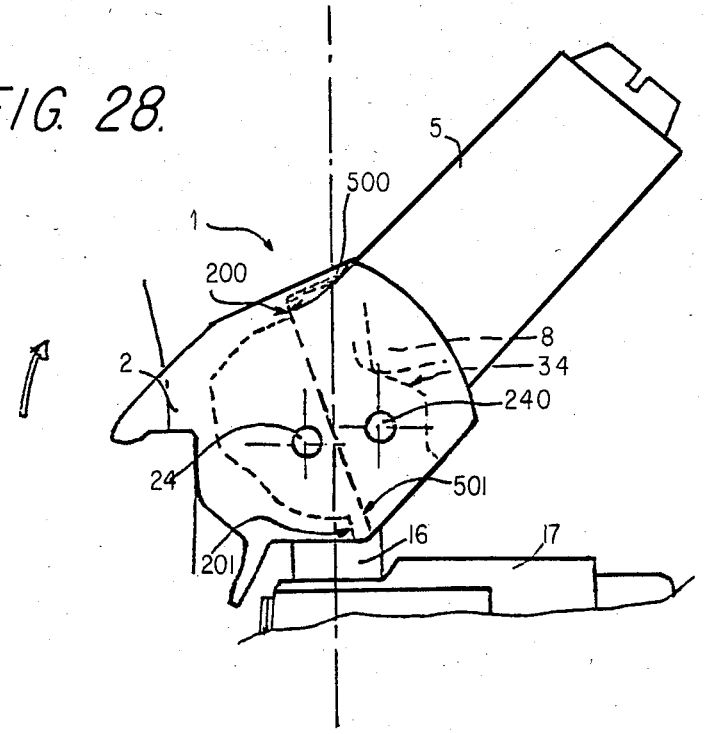
FIGS. 28–30 illustrate an embodiment where the body 5 is not integral with the jaw.
Figure 29:
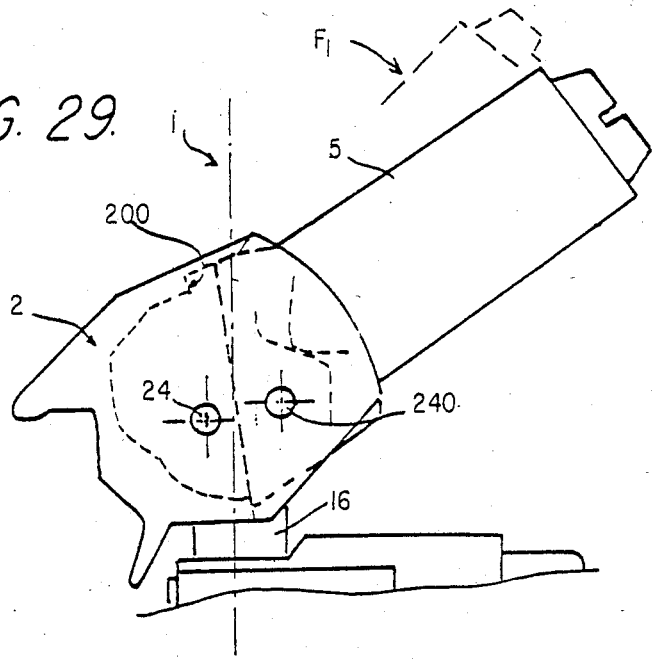
Figure 30:
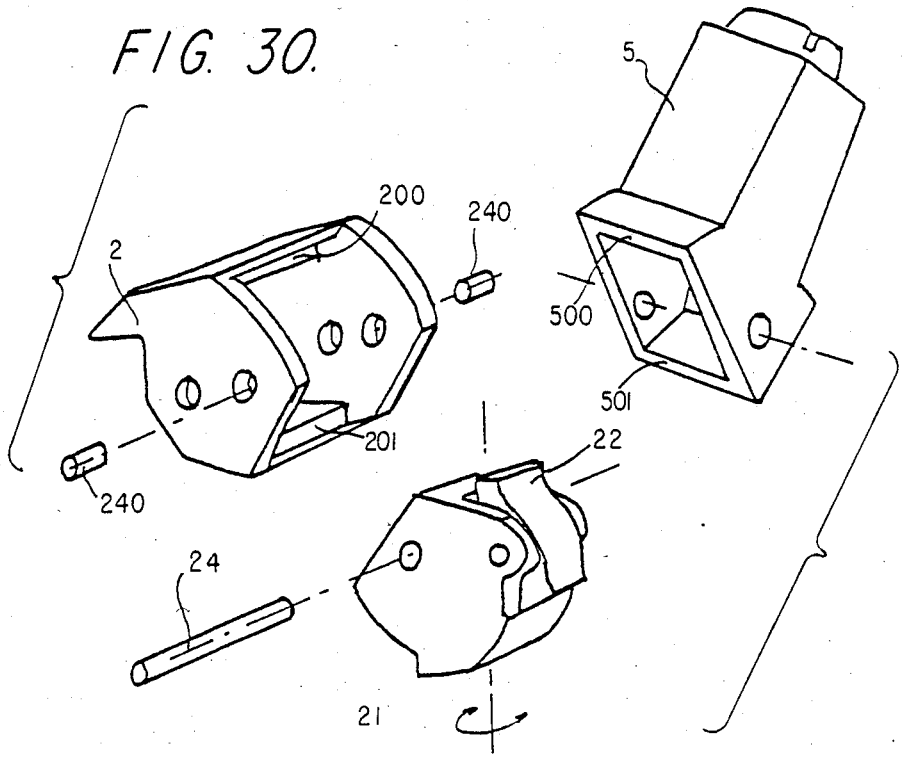

FIG. 28 illustrates the binding in the latched retention position of the shoe. It is noted that the shoulder 200 of the jaw 2 is supported against the shoulder 500 of the body 5 and during the vertical safety release along the direction $F_1$, the jaw rotates the body 5 as if the body 5 was monoblock with the jaw. On the other hand, manual release occurs in two phases. The first phase is the pivoting around the axis 240 of the body 5 alone with respect to jaw 2 up until the shoulder 501 presses against the shoulder 201. During the second phase, the body 5 pivots the jaw 2 around axis 24 and the retention assembly 1 acts as if it was made of unitary construction as is the case in FIG. 1. With the body 5 separated, the release is easier than if the retention assembly 1 is monoblock. In effect, with a monoblock retention assembly 1 the manual release is accompanied by a greater compression of the spring than is the case where the body 5 is separated as in FIGS. 28 and 29.

It is self-evident that notches 480 and 481 can have any shape and can even be projections, in which case corresponding notches are positioned on the rocker.

Although the invention has been described primarily with respect to a binding used to secure the heel of the shoe or boot onto a ski, it is to be understood that the invention is not limited to this particular embodiment and that it can be used to secure either the toe or heel portion of the shoe and that the binding of the invention can be used in combination with other bindings.

Although the invention has been described with respect to particular means and embodiments, it is to be understood that the invention is not limited to the particulars disclosed and extends to all equivalents falling within the scope of the claims.

What is claimed is:

1. A ski safety binding adapted to maintain one end of a ski boot or shoe secured to a ski, said binding comprising:

(a) a jaw adapted to secure the sole of a shoe or boot to said ski, when said binding is in the locked position;

(b) a pivot adapted to be secured to said ski;

(c) a rotatable element mounted pivotably on said pivot; and (d) a body comprising a housing, an elastic system in said housing, and a movable element in said housing and adapted to be biased against a rocker by said elastic system, said rocker being pivotably mounted relative to said rotatable element, wherein said pivot comprises a support surface integral therewith, adapted to support said rocker during pivoting of said rotatable support element around said pivot, wherein the bias of said movable element against said rocker is adapted to bias said jaw against said sole when said binding is in the locked position, wherein said housing and said movable element and said elastic system pivot vertically in response to vertical pivoting of said jaw.

2. The ski safety binding as defined by claim 1, further comprising an incline on said rocker, and wherein said movable element is biased against said incline and exerts a vertical force on said body when said binding is in the locked position.

3. The ski safety binding as defined by claim 1, wherein said body extends rearwardly away from said pivot.

4. The ski safety binding as defined by claim 1, wherein said body and jaw are two distinct elements.

5. The ski safety binding as defined by claim 4, wherein said body is pivotably secured to said jaw along a first axis transverse to the longitudinal axis of said pivot and wherein said rotatable element is positioned in a space provided between said jaw and said body, said jaw being pivotably mounted on said rotatable element along a second axis transverse to the longitudinal axis of said pivot.

6. The ski safety binding as defined by claim 5, wherein a portion of said jaw and a portion of said body are biased into direct physical contact with each other when said binding is in the locked position and whereby manual release of said binding occurs in two distinct phases around each of said first and second axes.

7. The ski safety binding as defined by claim 6, comprising a two-stop mechanism, each of said stops being positioned on opposite sides of said rotatable element.

8. The ski safety binding as defined by claim 1, wherein said pivot is generally cylindrical.

9. The ski safety binding as defined by claim 8, wherein said pivot comprises one notch adapted to seat a pin generally transverse to said pivot which pivotably secures said jaw to said pivot.

10. The ski safety binding as defined by claim 1, wherein said support surface is flat and wherein said rocker comprises a flattened surface adapted to contact said flat support surface of said pivot whereby rotation of said rocker around said pivot angularly and rotationally displaces said surfaces, whereby said rocker compresses said movable element which resists said displacement.

11. The ski safety binding as defined by claim 1, wherein said support surface on said pivot is a "V"-shaped notch.

12. The ski safety binding as defined by claim 1, wherein said support surface of said pivot comprises a flattened portion bordered by two projection portions.

13. The ski safety binding as defined by claim 1, wherein said support surface comprises a projecting rib.

14. The ski safety binding as defined by claim 13, wherein said rocker comprises a notch adapted to seat said projecting rib, whereby rotation of said rocker around said pivot angularly and translationally displaces said projecting rib relative to said notch.

15. The ski safety binding as defined by claim 1, wherein said rotatable element comprises a vertical bore adapted to fit on said pivot and first and second sets of horizontally arranged bores adapted to provide first and second pivot axes for said jaw and said rocker relative to said pivot.

16. The ski safety binding as defined by claim 1, wherein said rotatable element comprises a vertical bore adapted to fit on said pivot and one set of horizontally arranged bores adapted to provide a common pivot axis for both of said jaw and said rocker relative to said pivot.

17. The ski safety binding as defined by claim 1, wherein said rocker comprises an opening adapted to seat said rotatable element.

18. The ski safety binding as defined by claim 1, wherein said rocker comprises a projection seated within a support surface on said pivot adapted to resist rotation of said rotatable element relative to said pivot.

19. The ski safety binding as defined by claim 1, wherein said rocker is biased by said movable element against said pivot against one of two support surfaces on said pivot.

20. The ski safety binding as defined by claim 19, wherein rotation of said rotatable element causes the relative translational movement of said movable element along said rocker, whereby bias of said rocker against either of said two support surfaces corresponds to two different stable positions of said jaw.

21. The ski safety binding as defined by claim 1, wherein said jaw comprises an interior surface adapted to cooperate with said pivot to resist lateral movement of said jaw when said jaw is in a position securing said shoe or boot to said ski.

22. The ski safety binding as defined by claim 21, wherein said interior surface of said jaw comprises a notch and said pivot comprises a projecting element adapted to be seated in said notch.

23. The ski safety binding as defined by claim 21, wherein said interior surface of said jaw comprises a projecting element and said pivot comprises a notch adapted to seat said projecting element.

24. The ski safety binding as defined by claim 1, wherein said rocker is pivotably mounted around a first pivot axis and said jaw is pivotably mounted around a second pivot axis, said first and second pivot axes being the same axis.

25. The ski safety binding as defined by claim 1, wherein said rocker is pivotably mounted around a first pivot axis and said jaw is pivotably mounted around a second pivot axis, said first and second axes being different axes.

26. The ski safety binding as defined by claim 25, wherein said first pivot axis is positioned further from said ski than said second pivot axis.

27. A ski safety binding adapted to maintain one end of a ski boot or shoe secured to a ski, said binding comprising:

(a) a jaw adapted to secure the sole of a shoe or boot to said ski, when said binding is in the locked position;

(b) a pivot adapted to be secured to said ski;

(c) a rotatable element mounted pivotably on said pivot; and (d) a body comprising a movable element adapted to be biased against a rocker, said rocker being pivotably mounted relative to said rotatable element, wherein said pivot comprises a support surface integral therewith, adapted to support said rocker during pivoting of said rotatable support element around said pivot; and wherein the bias of said movable element against said rocker is adapted to bias said jaw against said sole when said binding is in the locked position, wherein said binding further comprises an incline on said rocker, and wherein said movable element is biased against said incline and exerts a vertical force on said body when said binding is in the locked position, wherein said incline is configured to bias said jaw away from said sole upon movement of said movable element past a release point on said incline due to upward force exerted on said jaw by said sole.

28. A ski safety binding adapted to maintain one end of a ski boot or shoe secured to a ski, said binding comprising:

(a) a jaw adapted to secure the sole of a shoe or boot to said ski, when said binding is in the locked position;

(b) a pivot adapted to be secured to said ski;

(c) a rotatable element mounted pivotably on said pivot; and (d) a body comprising a movable element adapted to be biased against a rocker, said rocker being pivotably mounted relative to said rotatable element, wherein said pivot comprises a support surface integral therewith, adapted to support said rocker during pivoting of said rotatable support element around said pivot, wherein the bias of said movable element against said rocker is adapted to bias said jaw against said sole when said binding is in the locked position, wherein said body is integral with said jaw.

29. A ski safety binding adapted to maintain one end of a ski boot or shoe secured to a ski, said binding comprising:

(a) a jaw adapted to secure the sole of a shoe or boot to said ski, when said binding is in the locked position;

(b) a pivot adapted to be secured to said ski;

(c) a rotatable element mounted pivotably on said pivot; and (d) a body comprising a movable element adapted to be biased against a rocker, said rocker being pivotably mounted relative to said rotatable element, wherein said pivot comprises a support surface integral therewith, adapted to support said rocker during pivoting of said rotatable support element around said pivot, wherein the bias of said movable element against said rocker is adapted to bias said jaw against said sole when said binding is in the locked position, wherein said rocker has an incline on the rear surface thereof, against which said movable element is biased, said incline comprising a release portion adapted to force said movable element away from said pivot during upward vertical movement of said jaw and a holding portion adapted to hold said jaw in the open position, said release and holding portions being separated by a release point.

30. A ski binding adapted to maintain one end of a ski boot or shoe secured to a ski, said binding comprising:

(a) a jaw adapted to secure the sole of a shoe or boot to said ski, when said binding is in the locked position;

(b) a pivot adapted to be secured to said ski;

(c) a rotatable element mounted pivotably on said pivot; and (d) a body comprising a movable element adapted to be biased against a rocker, said rocker being pivotably mounted relative to said rotatable element, wherein said pivot comprises a support surface integral therewith, adapted to support said rocker during pivoting of said rotatable support element around said pivot wherein the bias of said movable element against said rocker is adapted to bias said jaw against said sole when said binding is in the locked position, wherein said movable element is a piston comprising a pressure nose slidably mounted within said body.

31. The ski safety binding as defined by claim 30, wherein said piston comprises a longitudinal groove and said body comprises a finger secured to said body, said finger being adapted to slidably extend into said groove to prevent rotation of said piston relative to said body.

32. A ski safety binding adapted to maintain one end of a ski boot or shoe secured to a ski, said binding comprising:

(a) a jaw adapted to secure the sole of a shoe or boot to said ski, when said binding is in the locked position;

(b) a pivot adapted to be secured to said ski;

(c) a rotatable element mounted pivotably on said pivot; and (d) a body comprising a housing, an elastic system in said housing, and a movable element in said housing adapted to be biased against a rocker by said elastic system, said rocker being pivotably mounted relative to said rotatable element, wherein said rotatable element further comprises a vertical bore adapted to fit on said pivot and first and second sets of horizontally arranged bores adapted to provide first and second pivot axes for said jaw and said rocker relative to said pivot, wherein the bias of said movable element against said rocker is adapted to bias said jaw against said sole when said binding is in the locked position, wherein said movable element, said elastic system, and said housing pivot vertically in response to vertical pivoting of said jaw.

33. A ski safety binding adapted to maintain one end of a ski boot or shoe secured to a ski, said binding comprising:

(a) a jaw adapted to secure the sole of a shoe or boot to said ski, when said binding is in the locked position, (b) a pivot adapted to be secured to said ski;

(c) a rotatable element mounted pivotably on said pivot; and (d) a body comprising a housing, an elastic system in said housing, and a movable element in said housing adapted to be biased against a rocker, by said elastic system, said rocker being pivotably mounted relative to said rotatable element, wherein said rocker comprises means for pivoting relative to said rotatable element only in response to a vertical and lateral force acting on said jaw, wherein the bias of said movable element against said rocker is adapted to bias said jaw against said sole when said binding is in the locked position, wherein said movable element, said elastic system and said housing pivot vertically in response to vertical pivoting of said jaw.

34. The safety ski binding as defined by claim 33, wherein said pivot comprises a flat support surface integral therewith and said rocker further comprises a flattened surface adapted to contact said flat support surface of said pivot.

35. The safety ski binding as defined by claim 34 wherein said rocker is pivotably mounted on said rotatable element around a transverse axis and wherein said rocker comprises means for pivoting around said transverse axis against said movable element in a direction opposed to said bias on said movable element in response to simultaneous vertical and lateral forces acting on said jaw.

36. A ski safety binding adapted to maintain one end of a ski boot or shoe secured to a ski, said binding comprising:

(a) a jaw adapted to secure the sole of a shoe or boot to said ski, when said binding is in the locked position;

(b) a pivot adapted to be secured to said ski;

(c) a rotatable element comprising a cap having a downwardly directed opening for receiving the top of said pivot therein, wherein said cap is mounted pivotably on said pivot; and (d) a body comprising a housing, an elastic system in said housing, and a movable element in said housing comprising a piston, adapted to be biased against a rocker by said elastic system, said rocker being pivotably mounted relative to said rotatable element; and wherein the bias of said movable element against said rocker is adapted to bias said jaw against said sole when said binding is in the locked position, wherein said piston, said elastic system and said housing pivot vertically in response to vertical pivoting of said jaw.

37. A ski safety binding adapted to maintain one end of a ski boot or shoe secured to a ski, said binding comprising:

(a) a jaw adapted to secure the sole of a shoe or boot to said ski, when said binding is in the locked position;

(b) a pivot adapted to be secured to said ski;

(c) a rotatable element mounted pivotably on said pivot; and (d) a body comprising a movable element adapted to be biased against a rocker, said rocker being pivotably mounted relative to said rotatable element, wherein said pivot comprises a support surface integral therewith, adapted to support said rocker during pivoting of said rotatable support element around said pivot; and wherein the bias of said movable element against said rocker is adapted to bias said jaw against said sole when said binding is in the locked position, wherein said movable element is vertically pivotable around the same axis as said jaw in response to vertical pivoting of said jaw.

* * * * *